United States Patent [19]

Purcocks

[11] 4,453,851

[45] Jun. 12, 1984

[54] SECURING DEVICE, THE FORMATION THEREOF, AND A BINDER SYSTEM

[76] Inventor: Dale M. Purcocks, P.O. Box 159, Mayfair, Johannesburg, South Africa

[21] Appl. No.: 140,929

[22] Filed: Apr. 16, 1980

[30] Foreign Application Priority Data

Apr. 19, 1979 [ZA] South Africa ..... 79/1859

[51] Int. Cl.[3] ..... B42F 13/14

[52] U.S. Cl. ..... 402/15; 402/68; 24/153

[58] Field of Search ..... 24/67 R, 63, 67.7, 153, 24/153.1, 157, 17 A; 402/14, 16, 68, 15, 17, 80 R

[56] References Cited

U.S. PATENT DOCUMENTS

| | | | |
|---|---|---|---|
| 1,359,606 | 11/1920 | Knoch | 402/16 |
| 2,314,532 | 3/1943 | Wagner | 24/153.1 |
| 2,523,922 | 9/1950 | Neuschwander | 402/68 |
| 2,595,108 | 4/1952 | Schoenberger | 402/17 |
| 3,042,985 | 7/1962 | Dalferes | 402/17 |
| 3,285,250 | 11/1966 | Ivory et al. | 24/153 R X |
| 3,362,241 | 1/1968 | Moller | 402/15 |
| 3,628,877 | 12/1971 | Barnes | 402/80 R X |
| 4,070,736 | 1/1978 | Land | 402/15 X |
| 4,121,892 | 10/1978 | Nes | 402/17 |
| 4,256,411 | 3/1981 | Podosek | 402/19 X |

*Primary Examiner*—Paul A. Bell
*Assistant Examiner*—John S. Brown
*Attorney, Agent, or Firm*—Ladas & Parry

[57] ABSTRACT

The invention relates to a securing device conventionally used in conjunction with a sheet material binder system for securing one or more binder strap relative to the securing device, to secure a number of sheets of material together. The securing device has a channel section body portion in which a binder strap is receivable via an aperture in the securing device and a clamp member extending integrally from the body portion and being pivotally displaceable to clamp the binder strap in position within the body portion, a locking means being provided to lock the clamping member relative to the body portion. The securing means may be a double securing means having a single body portion and two clamping members extending integrally therefrom at opposite ends and two apertures through which binder straps can pass to be secured within the body portion by the clamping members. The invention thus also extends to a binder system including such a securing means and to a method of forming such a securing means which includes moulding the securing means as an integral unit in a single moulding operation.

40 Claims, 12 Drawing Figures

SECURING DEVICE, THE FORMATION THEREOF, AND A BINDER SYSTEM

This invention relates to a securing device, to the formation thereof, and to a binder system.

According to the invention, there is provided a securing device for use in securing a binder strap in a sheet material binder system, the securing device comprising a base member having a securing zone for receiving portion of a binder strap to be secured, a clamping member which is integral with the base member and extends pivotally therefrom to be pivotally displaceable between an inoperative position and a clamping position for clamping a binder strap in the securing zone, and locking means for locking the clamping member in its clamping position.

The locking means may conveniently be in the form of releasable locking means.

In an embodiment of the invention, the locking means may be provided by displaceable or by resiliently deformable locking formations on one member to co-operate with the other member or with complementary locking formations on the other member.

In an embodiment of the invention, the securing zone may be defined by a channel section portion of the base member to provide a base wall and a pair of opposed side walls.

In this embodiment, the clamping member may be receivable in the securing zone between the side walls in its clamping position, and the locking means may comprise resiliently deformable locking flanges projecting inwardly from the side walls to co-operate with opposed edges of the clamping member.

The locking flanges may conveniently, for example, be provided at spaced intervals along the side walls.

The securing device may have a threading aperture through which a free end portion of a binder strap may be threaded for positioning it in the securing zone.

The threading aperture may thus, for example, be provided in the base member, in the clamping member, or at the junction of the base member and clamping member.

If desired, threading apertures may be provided at spaced intervals.

The clamping member may be integral with the base member by the securing device, for example, being formed out of a single strip of deformable material, by the securing device being moulded as a unit out of a suitable synthetic plastics material, or the like.

It will be appreciated that a suitable synthetic plastics material would be a material which can be moulded to provide a securing device of sufficient strength for effective use, and which can allow pivotal displacement of the clamping member for a sufficient number of times without fracture along the pivot zone.

Thus, for example, a suitable material may be polypropylene or the like.

The securing zone and/or the operative surface of the clamping member may be roughened to combat slipping of a secured binder strap.

In an embodiment of the invention, where the securing device is intended for use with a flexible binder strap, complementary co-operating ridges and grooves may be provided on the base wall of the securing zone and on the operative surface of the clamping member.

In an embodiment of the invention, the securing device may be in the form of a double securing device by the base number being elongated and having corresponding securing zones, clamping members, and locking means at its opposed ends for securing the free end portions of two binder straps, or the two free end portions of one binder strap.

The invention further extends to a binder system comprising a securing device as described, and a binder strap.

In this embodiment of the invention, the securing device may conveniently be in the form of a double securing device for securing the two free ends of a binder strap after they have been threaded through apertures in sheet material to be bound.

The free edges of the binder strap may conveniently be roughened, such as, for example, by calendering, to cooperate with the roughened portions of the securing device.

The binder strap may, if desired, be mounted on a folder or cover sheet by means of rivets, by means of an adhesive, or the like.

The binder strap may be formed out of a flexible or resiliently flexible metal, metal alloy, synthetic plastics material, or the like.

In an embodiment of the invention, the securing device may have mounting means for mounting the device on a cover sheet.

In an embodiment of the invention, the mounting means may comprise a mounting panel which is integral with the base member and extends pivotally therefrom, the base member and mounting panel having formations to be engaged for securing the free edge portion of the mounting panel to the base member with a cover sheet edge portion sandwiched and located between them.

The mating formations may conveniently, for example, comprise pins to co-operate with complementary bores.

The securing device of this invention may therefore be employed in a binder system as such, in association with a cover sheet or binder cover, mounted on a cover sheet or binder cover, or as an integral part of a cover sheet or binder cover.

While the securing device and/or binder system of this invention may be used for binding various types of sheet materials, they can have particular application in regard to the binding of stationery which is in loose leaf form. They can, in addition, for example, have particular application in regard to the binding of computer sheets and the like.

The invention further extends to a method of forming a securing device as described herein, which includes the step of moulding the device as an integral unit in a single moulding operation.

In one embodiment of the invention, the device may be moulded in a mould having one or more removable cores to define the locking formations of the securing device. In an alternative embodiment of the invention, the securing device may be moulded in a mould in which one of the mould portions has mould pins which are arranged to extend through the base member and into the securing zone of the base member, to cooperate with the other mould portion and define cavities for the formation of the locking formations of the base member.

Embodiments of the invention are now described by way of example with reference to the accompanying drawings.

In the drawings

FIG. 1 shows a plan view of one embodiment of a double securing device in accordance with this invention for use in securing a binder strap in a stationery binder system;

FIGS. 2, 3, and 4 show cross-sectional views of the securing device of FIG. 1 along lines II—II, III—III, and IV—IV respectively;

Figure 8:
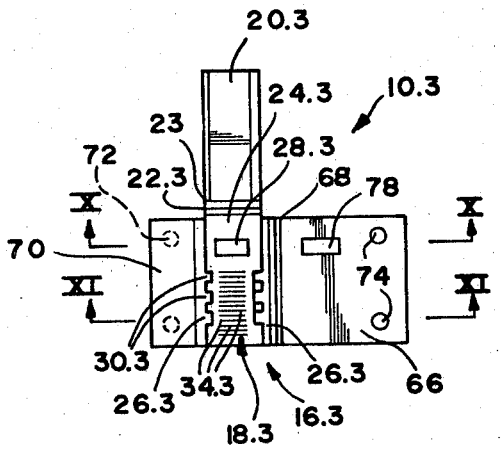
FIG. 8 shows a plan view of an alternative embodiment of a securing device in accordance with this invention.
Figure 9:
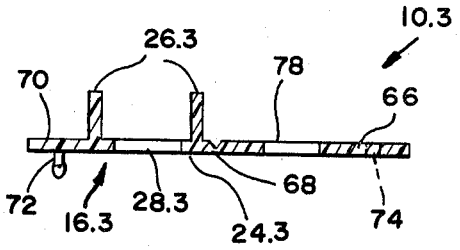
FIGS. 9 and 10 show cross-sectional views of the securing device of FIG. 8, along lines X—X, and XI—XI respectively.
Figure 10:
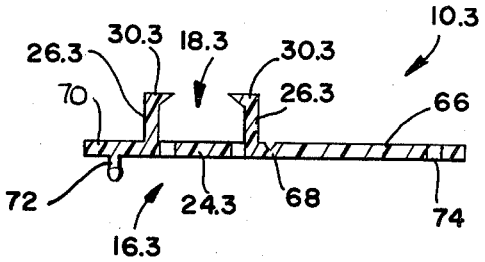
Figure 11:
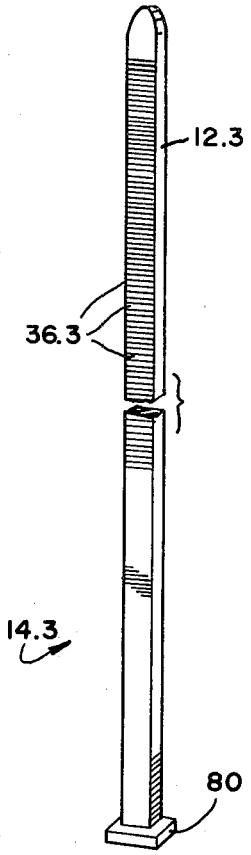
Figure 12:
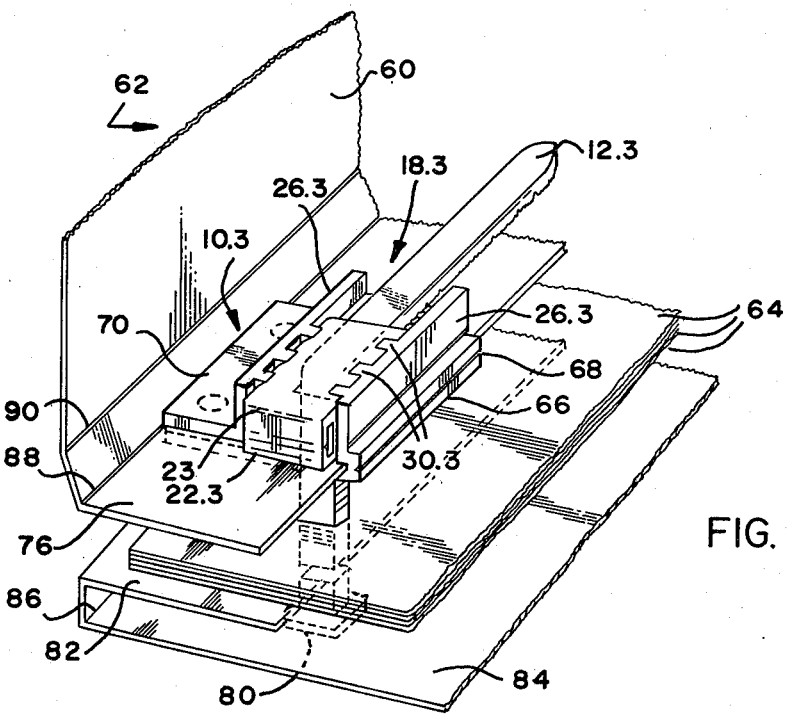

FIG. 11 shows a perspective view of a binder strap suitable for use with the securing device of FIG. 8; and FIG. 12 shows, to an enlarged scale, a fragmentary, perspective view of a binder system including a pair of the securing devices of FIG. 8 (only one being shown), a pair of the binder straps of FIG. 11 (only one being shown) in their operative condition to bind computer sheets in a pair of binder covers.

With reference to FIGS. 1 to 6 of the drawings, reference numeral 10.1 refers generally to a double securing device for use in securing free end portions 12.1 of a binder strap 14.1 in a loose leaf stationery binder system.

The double securing device 10.1 comprises an elongated base member 16.1 having securing zones 18.1 at its opposed ends for receiving the free end portions 12.1 of the binder strap 14.1.

The double securing device 10.1 further comprises two clamping members 20.1 which are integral in one piece with the base member 16.1, and which extend therefrom to be pivotally displaceable about pivot zones 22.1 relatively to the base member 16.1, so that they can fold effectively on to the base member 16.1.

The base member 16.1 is of channel section having a base wall 24.1 and a pair of opposed side walls 26.1.

The securing zones 18.1 are thus defined by the opposed end portions of the base wall 24.1 and the side walls 26.1, whereas the intermediate portion of the base member 16.1 is reinforced by the side walls 26.1.

Figure 1:
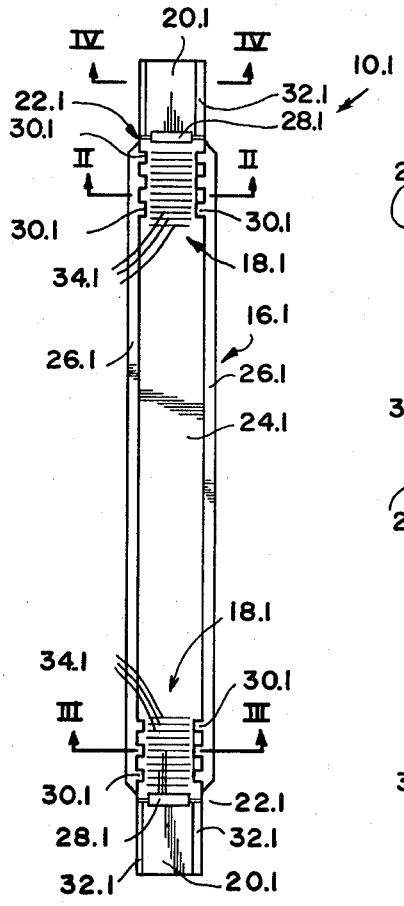
Figure 2:
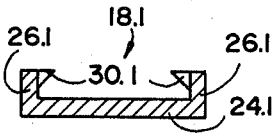
Figure 3:
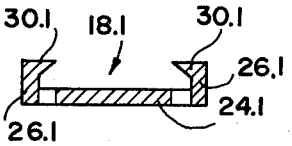
Figure 6:
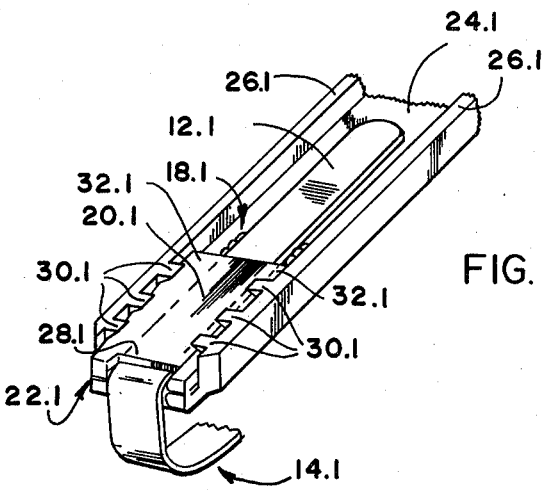
FIG. 6 shows, to an enlarged scale, a fragmentary, perspective view of a binder system comprising the binder strap of FIG. 5 secured by the securing device of FIG. 1.

Each clamping member 20.1 is pivotally displaceable about its pivot zone 22.1 between its inoperative position as shown in FIG. 1 of the drawings, and its operative clamping position as shown in FIG. 6 of the drawings, where it is received in the securing zone 18.1 between the opposed side walls 26.1 for clamping the binder strap end portion 12.1 in position in the securing zone 18.1.

The double securing device 10.1 includes a pair of threading apertures 28.1 through which the free end portions 12.1 are threaded for positioning them in the securing zones 18.1.

The threading apertures 28.1 are provided at the junctions of the clamping members 20.1 and the base member 16.1 in the pivot zones 22.1.

By providing the threading apertures 28.1 in the pivot zones 22.1, pivotal displacement of the clamping members 20.1 about the pivot zones 22.1 will be facilitated.

Each pivot zone 22.1 is defined by a zone of weakness which in the example shown is a zone of reduced thickness to allow pivotal displacement of clamping members 20.1 about the pivot zone 22.1, thus permitting the clamping members to effectively fold on to base member 16.1 into their operative clamping positions.

The double securing device 10.1 includes locking means for locking the clamping members 20.1 in their clamping positions.

The locking means is provided by resiliently deformable locking flanges 30.1 which are provided at spaced intervals along the securing zones 18.1, and which project inwardly from the side walls 26.1 to co-operate with opposed edges 32.1 of the clamping members 20.1.

Figure 4:
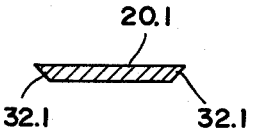

As can be seen in FIG. 4, the opposed edges 32.1 are tapered to facilitate insertion of the clamping members 20.1 into the securing zones 18.1.

The base wall 24.1 in the securing zones 18.1 is roughened by having transversely extending, laterally spaced ridges 34.1 provided thereon to combat slipping of the free end portions 12.1 out of the securing zones 18.1 during use.

The clamping members 20.1 are integral with the base member 16.1 by the double securing device 10.1 being moulded as a unit in a suitable mould, out of a suitable synthetic plastics material which will allow the double securing device 10.1 to have sufficient strength and rigidity for effective use, but will allow the clamping members 20.1 to be pivotally displaced about the pivot zones 22.1 for a sufficient number of times without fracture, to permit effective use.

The double securing device 10.1 is conveniently moulded out of a suitable synthetic plastics material such as, for example, polypropylene.

The binder strap 14.1 is formed by cutting out of extruded sheets of resiliently flexible synthetic plastics material such as, for example, polypropylene or the like.

Figure 5:
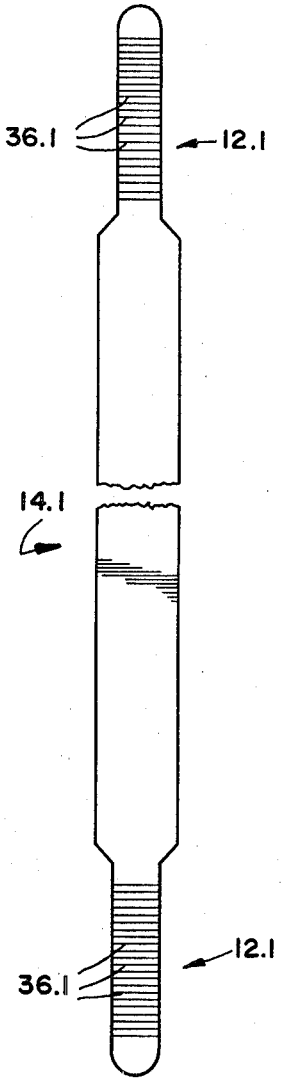
FIG. 5 shows a plan view of a binder strap for use with the securing device of FIG. 1 in a stationery binding system.

After extrusion or after cutting, the free end portions on the upper face of the binder strap 14.1 (as shown in FIG. 5) are calendered to provide laterally spaced transversely extending ridges 36.1 for co-operating with the ridges 34.1 of the securing zones 18.1 to combat any tendency for the free end portions 12.1 to slip out of the securing zones 18.1 during use.

It will be appreciated that the dimensions of the securing zones 18.1 and locking flanges 30.1, and the thickness of the clamping members 20.1 will be related to the thickness of the end portions 12.1 to ensure a firm and positive clamping action when the free end portions are clamped in the securing zones 18.1.

Figure 7:
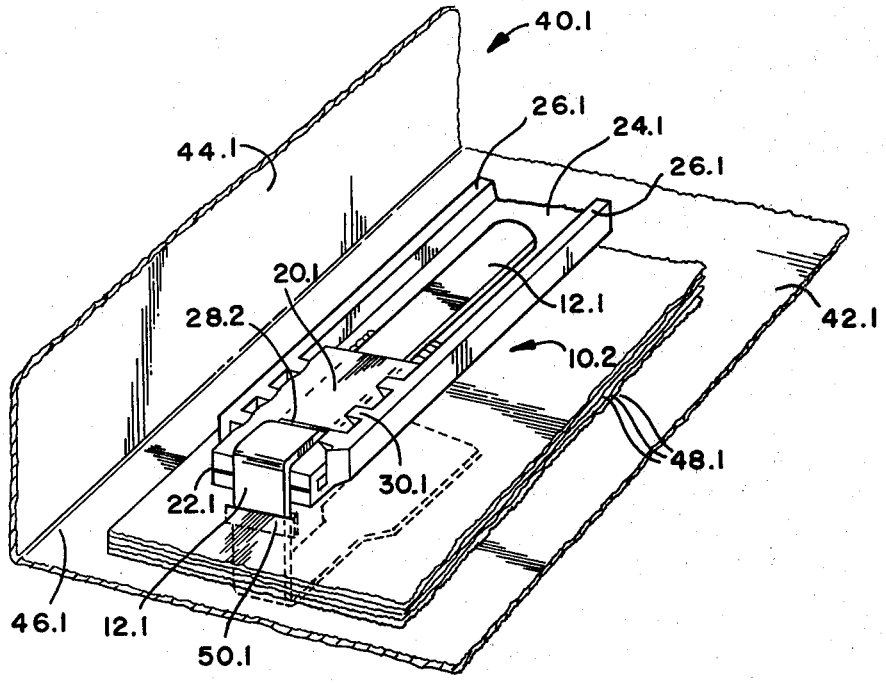
FIG. 7 shows a view similar to that of FIG. 6, of an alternative embodiment of the securing device of this invention, but with the device shown in its operative position to bind loose leaf sheets in a folder.

With reference to FIG. 7 of the drawings, reference numeral 40.1 refers generally to a stationery binder system comprising a binder folder having a rear cover sheet 42.1 and a front cover sheet 44.1 which are integral and are foldable relatively to each other about a foldline 46.1.

The stationery binder system 40.1 further comprises a binder strap 14.1 which is connected to the rear cover sheet 42.1 by means of an adhesive, and has the free end portions 12.1 extending through suitable apertures in the rear cover sheet 42.1.

The binder system 40.1 further includes a double securing device 10.2 which corresponds in all respects with the double securing device 10.1 except that it has its threading apertures 28.2 provided in the clamping members 20.1 rather than in the pivot zones 22.1.

Since the double securing device 10.2 corresponds in all other respects with the double securing device 10.1, corresponding parts are indicated by the corresponding reference numerals.

In the stationery binder system 40.1, the double securing device 10.2 and binder 14.1 are shown in their operative positions where loose leaf sheets 48.1 are bound in position in the binder folder.

Each sheet 48.1 has suitably positioned apertures 50.1 through which the free end portions 12.1 are threaded to locate the sheets 48.1 in the folder.

Thereafter, in use, the free end portions 12.1 can be threaded through the threading apertures 28.2 (or threading apertures 28.1 in the case of the double securing device 10.1) the free end portions 12.1 can be tensioned, and the clamping members 20.1 can then be pivotally displaced into their operative clamping positions where they clamp the free end portions 12.1 in the securing zones 18.1.

In the clamping positions, the ridges 36.1 of the free end portions 12.1 co-operate with the ridges 34.1 to combat slippage.

Further, in the clamping positions, the locking flanges 30.1 co-operate with the edges 32.1 of the clamping members 20.1 to releasably lock the clamping members 20.1 in their clamping positions.

Since the rear surfaces of the free end portions 12.1 are smooth, as are the operative surfaces of the clamping members 20.1, removal and insertion of the free end portions 12.1 relatively to the securing zones 18.1 will not tend to be hampered.

To release the free end portions 12.1, the free end portions can be gripped and pulled upwardly away from the base member 16.1 thereby forcing the clamping members 20.1 upwardly until the locking flanges 30.1 haave been resiliently deformed sufficiently to release the clamping members 20.1.

In the case of the double securing device 10.2, since the threading apertures 28.2 are provided in the clamping members 20.1, a degree of tensioning can be applied to the end portions 12.1 during use, if desired.

Thus, in use, the free end portions 12.1 can be threaded through the threading apertures 28.2 while the clamping members 20.1 are in their inoperative positions (as in FIG. 1). Thereafter, the free end portions 12.1 can be tensioned and held with the clamping members 20.1 while the clamping members are pivotally displaced into their operative clamping positions. During such pivotal displacement additional tensioning of the binder strap 14.1 will be effected thereby providing a firmer binding of the sheets 48.1 in the folder.

While applicant is aware of various binder systems for use in the binding of stationery, the systems suffer from the disadvantages that they are expensive and do not provide a positive locking action for the binder straps in the securing devices.

The binder systems known to applicant are expensive because they are formed out of separately formed components which are formed separately in a series of steps out of deformable material, or are formed separately by moulding, and then require assembly prior to use. Not only does assembly tend to be costly, but the separate moulding stages will tend to be more costly than a single moulding operation.

The embodiments of the invention as illustrated in the drawings therefore provide the advantage that the double securing devices 10.1 and 10.2 can be moulded in a single moulding operation by using relatively simple moulds, and have no components which require separate moulding or separate assembly.

The embodiments as illustrated in the drawings provide the further advantage that the binder straps 14.1 can be formed by any conventional means, and can be positively located in a simple and effective manner in the securing zones 18.1.

The embodiments as illustrated in the drawings provide the further advantage that the free end portions 12.1 can readily be released when further sheets are to be inserted, or sheets are to be removed.

Applicant further believes that the securing devices 10.1 as illustrated in FIGS. 1 to 7 of the drawings, can be formed more cheaply than other similar securing devices which applicant is aware of, and are immediately ready for effective operation without the need for assembly or the inconvenience of the loss of unassembled components.

With reference to FIGS. 8 to 12 of the drawings, reference numeral 10.3 refers generally to a single securing device for use in securing free end portions 12.3 of binder straps 14.3 in a binder system for computer sheets.

The single securing device 10.3 corresponds generally with an end portion of the double securing device 10.1 and corresponding parts are therefore indicated by corresponding reference numerals except that the suffix '.3' has been used in place of the suffix '.1'.

In the securing device 10.3, both the securing zone 18.3 and the clamping member 20.3 has been elongated in comparison with the securing zone 18.1 and clamping member 20.1.

In addition, the threading aperture 28.3 is provided in the base wall 24.3.

Furthermore, because the binder strap 14.3 is of rectangular section, two laterally spaced pivot zones 22.3 and 23 have been provided in the clamping member 20.3.

The securing device 10.3 further includes mounting means for mounting the securing device 10.3 on an edge portion of a binder cover 60 of a binder system 62 for computer sheets 64, as shown in FIG. 12 of the drawings.

The mounting means comprises a mounting panel 66 which is integral with the base member 16.3, and extends pivotally from the base member 16.3 to be pivotally displaceable relatively to the base member about a pivot zone 68.

The mounting means further comprises a locating panel 70 which extends integrally from the base member 16.3 on the opposed side to that of the mounting panel 66.

The locating panel 70 has two pins 72 with enlarged head portions depending therefrom, whereas the mounting panel 66 has two bores 74 provided therein for co-operating with the pins 72.

In use, appropriately positioned holes can be provided in an edge portion 76 of the binder cover 60 whereafter the pins 72 can be inserted through the holes. Thereafter the mounting panel 66 can be pivotally displaced about the pivot zone 68, and the enlarged head portions of the pins 72 can be forced through the bores 74 to locate the mounting panel 66 relatively to the locating panel 70 with the edge portion 76 of the binder cover 60 firmly clamped and sandwiched between the base member 16.3 and locating panel 70 on the one side, and the mounting panel 66 on the other side. In this way, in a simple and effective manner, the single securing device 10.3 can be readily and firmly located on the edge portion 76 for use.

The mounting panel 66 has a threading aperture 78 which will be in alignment with the threading aperture 28.3 in operative position, to allow the free end portion 12.3 of the binder strap 14.3 to be threaded therethrough.

The binder strap 14.3 may be moulded out of any suitable synthetic plastics material and is provided with ridges 36.3 to co-operate with the ridges 34.3 of the securing zone 18.3. While the ridges 36.3 are shown only on one side of the end portion 12.3, they may, for convenience, be provided on both sides.

The binder strap 14.3 is shown having a locating shoulder 80 at its one end. It will be appreciated, however, that, if desired, the binder strap 14.3 may be formed with free end portions 12.3 at its opposed ends so that it will be used with a pair of single securing devices 10.3.

In use, the binder strap 14.3 will be threaded through a suitable slot provided in an edge portion 82 of a lower binder cover 84. Thereafter the lower binder cover 84 can be folded along a foldline 86 to locate the locating shoulder 80 between the edge portion 82 and the remainder of the binder cover 84, as shown in FIG. 12.

It will be appreciated that, in practice, a pair of binder straps 14.3 will be used at opposed ends of the lower binder cover 84, and a pair of single securing devices 10.3 will be mounted at opposed ends of the edge portion 76 of the upper binder cover 60.

Thereafter the computer sheets 64 can be threaded onto the binder straps 14.3.

The free end portions 12.3 can then be threaded through the threading apertures 78 and 28.3 of the two securing devices 10.3, and the clamping members 20.3 can be displaced into their clamping positions to clamp the end portions 12.3 in the securing zones 18.3.

Thereafter the upper binder cover 60 can be folded along foldlines 88 and 90 to close the binder system 62.

It is an advantage of the embodiment of the invention as illustrated in FIGS. 8 to 12 of the drawings, that the single securing device 10.3 can be moulded as a unit in a single moulding operation thereby providing similar advantages to those as described with reference to FIGS. 1 to 7 of the drawings.

The embodiment illustrated in FIGS. 8 to 12 provides the further advantage that the securing device 10.3 can readily and effectively be mounted onto an edge portion of a binder cover, and that an end portion 12.3 of a binder strap 14.3 can be readily and effectively releasably clamped in the securing zone of the securing device 10.3.

The embodiment of the invention as illustrated in FIGS. 8 to 12, can therefore provide the advantage that a simple and effective binder system is provided for the binding of stationery and, in particular, stationery such as computer sheets and the like.

By selection of an appropriate synthetic plastics material, sufficient strength can be provided for effective use, and at the same time, the clamping member 20.3 can be pivotally displaced between its operative and inoperative positions for a sufficient number of times without fracture along the pivot zones 22.3 and 23 to permit effective use.

It will be appreciated that the securing device 10.3 can be moulded in a corresponding manner to that of the securing device 10.1.

I claim:

1. A sheet material binder system which includes a binder strap and a securing device for securing the binder strap, the securing device comprising a base member having a securing zone for receiving a portion of the binder strap, a clamping member integral in one piece with and extending from the base member, a pivot zone being defined between the clamping member and the base member to permit pivotal displacement of the clamping member relative to the base member between an inoperative position and a clamping position for clamping the binder strap in the securing zone and locking means for locking the clamping member in its clamping position.

2. A system as claimed in claim 1, in which the locking means is releasable locking means.

3. A system as claimed in claim 2, in which the locking means are locking formations on the clamping member which can co-operate with complementary locking formations on the base member for locking the clamping member in its clamping position.

4. A system as claimed in claim 1, in which the securing zone is defined by a channel section portion of the base member providing a base wall and a pair of opposing side walls.

5. A system as claimed in claim 4, in which the clamping member is receivable in the securing zone between the side walls in its clamping position, the clamping member and securing zone including complementary locking formations for locking the clamping member in its clamping position.

6. A system as claimed in claim 1, in which the securing device has a threading aperture through which a free end portion of the binder strap can be threaded to be receivable in the securing zone.

7. A system as claimed in claim 6, in which the threading aperture is disposed in the pivot zone between the clamping member and the base member.

8. A system as claimed in claim 6, in which the threading aperture is disposed in the clamping member.

9. A cover sheet, binder cover, or the like including a sheet material binder system as claimed in claim 1.

10. A system as claimed in claim 1, in which the surface of the clamping member which engages the binder strap during clamping is roughened to prevent slipping of the binder strap relative to the clamping member.

11. A system as claimed in claim 1, in which the clamping member and the binder strap include complementary formations which can engage one another during clamping to prevent slipping of the binder strap relative to the clamping member.

12. A system as claimed in claim 1, in which the securing device is in the form of a double securing device by the base member being elongated and having corresponding securing zones, clamping members and locking means at its opposed ends for securing two free end portions of at least one binder strap.

13. A system as claimed in claim 1, in which the binder strap is mounted on a folder, cover sheet, or the like.

14. A system as claimed in claim 1, in which the binder strap is of a resiliently flexible material.

15. A system as claimed in claim 1, in which the securing device has mounting means for mounting the device on a cover sheet.

16. A system as claimed in claim 15, in which the mounting means comprises a mounting panel integral with the base member of the securing device and extending pivotally therefrom, the mounting panel and the base member being adapted to receive a cover sheet edge portion between them.

17. A system as claimed in claim 16, in which the mounting means and base member include complementary mating formations for securing the edge portion of a cover sheet between them.

18. A system as claimed in claim 1, in which the securing device including the base member and the clamping member is in the form of a single strip of deformable material.

19. A system as claimed in claim 18, in which the securing device is moulded of a synthetic plastics material.

20. A system as claimed in claim 18, in which the pivot zone is a zone of weakness allowing pivotal displacement of the clamping member relative to the base member.

21. A system as claimed in claim 20, in which the zone of weakness is a zone of reduced thickness.

22. A securing device for use in securing a binder strap in a sheet material binder system, the securing device comprising a base member having a securing zone for receiving a portion of a binder strap, a clamping member integral in one piece with and extending from the base member, a pivot zone being defined between the clamping member and the base member to permit pivotal displacement of the clamping member relative to the base member between an inoperative position and a clamping position for clamping a binder strap in the securing zone, and locking means for locking the clamping member in its clamping position.

23. A device as claimed in claim 22, in which the locking means is releasable locking means.

24. A device as claimed in claim 23, in which the locking means are locking formations on the clamping member which can co-operate with complementary locking formations on the base member for locking the clamping member in its clamping position.

25. A device as claimed in claim 22, in which the base member and the clamping member is in the form of a single strip of deformable material.

26. A device as claimed in claim 25, in which the device is moulded of a synthetic plastics material.

27. A device as claimed in claim 22, in which the surface of the clamping member which engages a binder strap during clamping is roughened to prevent slipping of the binder strap relative to the clamping member.

28. A device as claimed in claim 22, in which the clamping member includes formations which can engage complementary formations on a binder strap during clamping to prevent slipping of the binder strap relative to the clamping member.

29. A device as claimed in claim 22, in which the device is in the form of a double securing device by the base member being elongated and having corresponding securing zones, clamping members and locking means at its opposed ends for securing two free end portions of at least one binder strap.

30. A device as claimed in claim 22, which includes mounting means for mounting the device on a cover sheet.

31. A device as claimed in claim 30, in which the mounting means comprises a mounting panel integral with the base member and extending pivotally therefrom, the mounting panel and the base member being adapted to receive a cover sheet edge portion between them.

32. A device as claimed in claim 31, in which the mounting means and the base member include complementary mating formations for securing an edge portion of a cover sheet between them.

33. A device as claimed in claim 22, in which the securing zone is defined by a channel section portion of the base member providing a base wall and a pair of side walls.

34. A device as claimed in claim 33, in which the clamping member is receivable in the securing zone between the side walls in its clamping position, the clamping member and securing zone including complementary locking formations for locking the clamping member in its clamping position.

35. A device as claimed in claim 22, in which the device has a threading aperture through which a free end portion of a binder strap can be threaded to be receivable in the securing zone.

36. A device as claimed in claim 35, in which the threading aperture is disposed in the pivot zone between the clamping member and the base member.

37. A device as claimed in claim 35, in which the threading aperture is disposed in the clamping member.

38. A device as claimed in claim 25, in which the pivot zone is of weakness allowing pivotal displacement of the clamping member relative to the base member.

39. A device as claimed in claim 38, in which the zone of weakness is a zone of reduced thickness.

40. A cover sheet, binder cover, or the like including a securing device as claimed in claim 22.

* * * * *